United States Patent [19]

Chatterji

[11] 4,049,505

[45] Sept. 20, 1977

[54] PHOTOCONDUCTORS FOR ELECTROSTATIC IMAGING SYSTEMS

[76] Inventor: Arun K. Chatterji, 5409 Fieldstone Drive, Raleigh, N.C. 27609

[21] Appl. No.: 676,400

[22] Filed: Apr. 12, 1976

Related U.S. Application Data

[60] Continuation-in-part of Ser. No. 512,332, Oct. 14, 1974, abandoned, which is a division of Ser. No. 443,689, Feb. 19, 1974, which is a division of Ser. No. 259,953, June 5, 1972, Pat. No. 3,792,964.

[51] Int. Cl.[2] ..... C25D 3/66; C25D 5/00

[52] U.S. Cl. ..... 204/38 R; 204/39; 96/1 PC; 96/1.5 R; 75/134 H; 75/135; 252/501; 148/183

[58] Field of Search ..... 204/38 R, 39; 96/1.5, 96/1 PC; 252/501; 338/15; 75/134 H, 135; 148/177, 183, 32

[56] References Cited

U.S. PATENT DOCUMENTS

| | | | |
|---|---|---|---|
| 3,490,903 | 1/1970 | Myers et al. | 96/1.5 |
| 3,723,105 | 3/1973 | Kitajima et al. | 75/134 H |
| 3,785,806 | 1/1974 | Henriksson | 75/134 H |
| 3,816,288 | 6/1974 | Lubicz et al. | 204/164 |
| 3,826,721 | 7/1974 | Hall | 204/39 |

*Primary Examiner*—John H. Mack
*Assistant Examiner*—Aaron Weisstuch
*Attorney, Agent, or Firm*—Shlesinger, Fitzsimmons & Shlesinger

[57] ABSTRACT

In one embodiment an improved photoconductor is produced by applying a layer of selenium to a substrate, and then diffusing arsenic into the selenium layer by an electrolytic process in which the arsenic and the coated substrate are suspended in a heated, fluoride salt bath, and a DC voltage is applied across the arsenic and the selenium layer to effect diffusion of the former into the latter. In another embodiment a layer of cadmium sulfide is applied to a substrate and silver or copper is diffused into the cadmium sulfide layer by an electrolytic process.

7 Claims, No Drawings

PHOTOCONDUCTORS FOR ELECTROSTATIC IMAGING SYSTEMS

This is a continuation-in-part of my U.S. application Ser. No. 512,332, filed Oct. 14, 1974, now abandoned, which was a division of application Ser. No. 443,689, filed Feb. 19, 1974, which in turn was a division of application Ser. No. 259,953, filed June 5, 1972, and now U.S. Pat. No. 3,792,964.

This invention relates to improved photoconductors for use in electrostatic imaging systems.

Many known copying systems, such as for example electrophotography, adherography, chemical copying including encapsulated imaging systems, etc., involve the basic steps of producing a latent image on a light sensitive surface; developing a corresponding visible image on a copy substrate (paper, etc.) by using, for example, a developer containing a toner of either electroscopic or non-electrical attributes; and then fixing the toner image on the substrate. In systems of the type described, latent images are focused by a light source and lens system onto the surface of, for example, a photoreceptor drum, or the like, which is coated with a light-sensitive photoconductor such as, for example, selenium or an alloy thereof. An electroscopic developer is then applied to the drum to form thereon a toner image over the latent image on the drum, after which the toner image is transferred to a substrate and fixed thereon by solvent, vapor, heat, pressure or combinations thereof, depending upon the copying system employed.

Examples of known photoconductors are vitreous selenium, amorphous alloys of selenium and arsenic and the like, and organic or inorganic photoconductors embedded in a photoconductive matrix and the like. Prior photoconductors of the high performance variety, however, have generally been produced by cladding a thin layer of a photoconductive material such as selenium, or an alloy thereof, to a substrate such as aluminum, or the like. Typically selenium and arsenic in molten states are mixed together to form a selenium/arsenic alloy, which is then deposited on the aluminum substrate by, for example, conventional vacuum evaporation techniques.

A major disadvantage of this clad-type of photoconductor is that, in contrast to pure vitreous selenium, the selenium/arsenic alloy, despite its superior spectral sensitivity and thermal stability, becomes extremely brittle upon being deposited on the substrate, and tends to develop stress cracks, which reduce the overall life of the photoconductor, or require the addition of dopants, thus making it more difficult and expensive to produce. It has been found that the undesirable brittleness of a photoconductor of this type can be obviated by applying or cladding the selenium element to the substrate first, and then diffusing the arsenic into the already deposited selenium.

An object of this invention is to provide improved photoconductors for use in copying systems of the type described.

Another object of this invention is to provide a novel process for producing an improved photoconductor of the type made from a selenium/arsenic alloy.

A further object of this invention is to provide an improved selenium/arsenic alloy photoconductor, which is substantially less brittle, and therefore longer lasting than prior such photoconductors.

Other objects of the invention will be apparent hereinafter from the specification and from the recital of the claims, which are appended hereto.

The novel selenium/arsenic alloy photoconductor produced by this invention involves the application or cladding of selenium onto a substrate, and the diffusion of arsenic into the selenium. This method is called metalliding, and is achieved by a high temperature electrolytic process in which the diffusing metal (for example arsenic), which serves as an anode, is suspended together with the receptor metal (for example selenium), which serves as a cathode, in a bath of molten fluoride salt that is maintained at a temperature between 300° to 1350° Centigrade and in an inert atmosphere, such as helium. A direct current is then passed from the anode to the cathode; and the anode material dissolves and is transported to, and is diffused into, the cathode, thus giving rise to a selenium/arsenic alloyed surface substantially less brittle than prior, known photoconductors of this type.

The above-described metalliding process may take from 20 to 150 minutes, during which time the current density may range from 0.05 to 10.0 amps/dm$^2$ and the applied voltage, which is placed across the anode-cathode electrodes, ranges from 0.01 to 1.1 volts. Preferably, however, the duration of the electrolysis process is from 20 seconds to 30 minutes, during which time the current density is maintained at approximately 1.5 amps/dm$^2$, and the impressed voltage approximately 0.2 volts. The duration of the process, of course, will obviously be effected by any change in the size of the electrodes, and spacing between electrodes, which by way of example may be in the range of from 4 cm. to 40 cm., as well as any change that might occur in the current density.

The solvent in the above-noted metalliding process is an alkali and/or alkaline earth metal fluoride. These fluorides combine with the fluorides of other metals to produce soluble and likely stable fluometallate anions (negative ions). Hence the "-iding" agents dissolve in the molten fluorides, whether those agents are a solid with a high melting point or a gas. Usually only a small amount (less than about 1%) of the -iding fluoride needs to be dissolved in the solvent fluoride for the metalliding reaction to take place. Metalliding reactions can be carried out by going against the electromotive series, which is not possible in conventional electrolysis, thus enabling the arseniding, antimoniding, germaniding, and the like, of the photoconductive selenium, if desired.

To obtain a ternary or quarternary alloyed surface, it is necessary to carry out more than one metalliding operation. Thus by employing these techniques unique photoconductors of tailored composite and chemical composition, which heretofore could not be clad satisfactorily onto a substrate, are now possible.

EXAMPLE I

A 60 microns thick selenium-coated aluminum substrate (with 3 × 5 inches area), to be used as the cathode was set up, without dipping the cathode into the $KHF_2$ salt bed, which when melted would become the electrolytic bath. Three arsenic rods (about ¼ inch average geometric diameter; not very circular), connected in series, formed the anode. The rods were hung from a stainless steel frame in such a fashion that the frame would not come in contact with the electrolytic bath.

The $KHF_2$ salt bed, which was contained in a three-necked pyrex reactor, was heated externally in an inert atmosphere of helium to about 360° C. When the salt was sufficiently fused, in about 15–17 minutes, the cathode and the anode were lowered into this fused bath. Only about half of the vertical length (about 2½ inches) of the selenium plate was under the electrolytic bath. The electrodes, which reached the bottom of the reactor, were kept about 6 cm. apart. The cathode and the anode were then externally connected through a battery.

An electronic stop watch was started to register the time of electrolysis operation. The impressed voltage varied between 0.25 to 0.20 volts during the arseniding of selenium. The arseniding process was terminated at exactly 30 seconds from the start of said electrolysis. The electrodes were raised above the electrolytic bath, but kept in the inert atmosphere of helium, until the reactor and its contents were cooled to about 60° C. Then the electrodes were taken out for examination. The arsenic anode had not visibly changed much, although some erosion could be seen in the dipped areas. The selenium cathode had two visibly different areas where different degrees of shine or reflectivity were apparent. The area exposed to helium, and the area metallided with arsenic, had bright and dull shines respectively.

In evaluating the two-zone photoconductor plate by the usual flat plate image making, using positive corona charging to about 700 surface volts, exposing to a document and developing with a standard Xerox 660 developer, both the bright and dull areas of the photoconductor appeared the same and produced excellent developed images. The image cleaning was also excellent in both the areas. Several arsenided selenium photoconductor plates were then made and they were subjected to the following tests:

i. Hold the latent image in the dark for 10 seconds before developing said latent image. The As alloyed portion, with dull shine did not develop, showing thereby that this new surface of photoconductor has the high speed capability of the advanced photoconductors since it has, with the metallided As in it, acquired high speed discharge characteristics.

ii. Put deep finger prints on both bright and dull shine areas. The finger prints were difficult to remove (using cotton) from the bright zone while the dull area cleaned with ease. The novel metallided photoconductor thus showed strong resistance to crystallization of the Se.

iii. Expose both bright and dull shine areas to an UV lamp for 10 hours. The dull area (with the As doping in it) produced better resolution of developed image (9 line pairs per mm Vs. 5 in the same units for the bright area), proving thereby that the As metallided Se photoconductor has superior resistance to light fatigue.

EXAMPLE II

Same as EXAMPLE I, except that the distance between the cathode and anode was approximately 10.0 cm., and the duration of the electrolysis was 1 minute and 20 seconds.

EXAMPLE III

In this case a small selenium drum, comprising a generally tubular aluminum cylinder having an inside diameter of approximately 3 inches, and being coated at its outer surface with a layer of selenium approximately 50 microns thick, was lowered into a salt bath containing, besides $KHF_2$, about 5% selenium tetrafluoride and 10% NaF. A plurality of vertically disposed arsenic rods were arranged in spaced, parallel relation in a circular path around the outside of the drum, and were electrically connected together to form the anode. The temperature of the bath was maintained at approximately 330° C; and a coolant was circulated in the bore of the drum to prevent excessive heating thereof, thus enabling the electrolysis to take place for a longer period of time without injuring the drum. The process was conducted in an inert atmosphere (in the presence of nitrogen), and for approximately 2 minutes and 38 seconds, with the distance between the electrodes held at approximately 12 cm. In a simulated process of charging up to 850 surface volts (positive) and its own dark discharging rate, the performance characteristics of this metallided photoconductor was set at correlated xerographic machine speed of 71 copies per minute.

EXAMPLE IV

Same as EXAMPLE I, except that an 80 micron thick cadmium sulfide layer was used in place of the selenium layer, and silver wires (nineteen wires, each 40 mils in diameter) were hung from a stainless steel frame and were used in place of arsenic. An inert helium atmosphere was maintained; and a fifty-fifty mixture of NaF and AgF was used as the salt bath. Temperature of the molten bath ranged from approximately 390° C to about 416° C, and the voltage was applied for approximately 4 minutes. A substantially improved CdS photoconductor (no loss of resolution, although 30% faster discharge) was achieved than without Ag doping.

EXAMPLE V

Same as EXAMPLE IV, except six copper rods, ⅛ inch in diameter each, were used in place of the silver anode. An inert helium atmosphere was maintained, and the salt bath was composed of 55% $KHF_2$ and 45% NaF. The bath temperature was maintained at approximately 375° C, and the time of the process was approximately 1 minute and 5 seconds. Resolution of the copper doped cadmium sulfide layer was the same as for the undoped cadmium sulfide, but the discharge rate was about 20% higher (i.e., copper metallided cadmium sulfide resulted in 20% higher speed).

From the foregoing it will be apparent that the instant invention provides ready means for improving the useful operating life and electrical characteristics of both composite and selenium/arsenic alloy types of photoconductors, and this application is intended to cover not only those embodiments disclosed in detail herein, but also any modifications thereof as may fall within the scope of one skilled in the art, or the appended claims.

Having thus described my invention, what I claim is:

1. The method of producing an alloyed photoconductor, comprising applying a layer of photoconductive material to a substrate, and diffusing an alloying metal into said layer by an electrolytic process, including placing the alloying metal and said layer in a heated, molten fluoride salt bath as the anode and cathode, respectively, applying a DC voltage across said anode and said cathode, and conducting said electrolytic process in an inert atmosphere.

2. The method as defined in claim 1, wherein said photoconductive material is selenium and said alloying metal is arsenic.

3. The method as defined in claim 2 wherein the molten fluoride salt bath is maintained at a temperature between 300° C to 1350° C.

4. The method as defined in claim 1, wherein said photoconductive material is cadmium sulfide, and said alloying metal is silver.

5. The method as defined in claim 4, wherein said molten fluoride salt bath comprises a mixture of NaF and AgF.

6. The method as defined in claim 1, wherein said photoconductive material is cadmium sulfide, and said alloying metal is copper.

7. The method as defined in claim 6, wherein said molten salt bath comprises a mixture of $KHF_2$ and NaF.

* * * * *